US006230341B1

(12) United States Patent
Dudley

(10) Patent No.: US 6,230,341 B1
(45) Date of Patent: May 15, 2001

(54) CENTER INDICATOR FOR BEDDING

(76) Inventor: Alice P. Dudley, 609 Cooper, California, MO (US) 65018

( * ) Notice: Subject to any disclaimer, the term of this patent is extended or adjusted under 35 U.S.C. 154(b) by 0 days.

(21) Appl. No.: 09/497,024

(22) Filed: Feb. 2, 2000

(51) Int. Cl.[7] ..... A47G 9/02

(52) U.S. Cl. ..... 5/482; 5/488; 5/907; 5/495; D6/602

(58) Field of Search ..... 5/482, 486, 488, 5/495, 907, 131, 132, 690; D6/602, 603

(56) References Cited

U.S. PATENT DOCUMENTS

| | | | | |
|---|---|---|---|---|
| 2,302,844 | * | 11/1942 | Ebbott | 5/482 X |
| 3,316,566 | * | 5/1967 | Long, Sr. | 5/495 |
| 3,654,646 | | 4/1972 | McMahon, Jr. | 5/334 |
| 3,855,655 | | 12/1974 | Propst | 5/31.7 |
| 3,895,404 | | 7/1975 | Wilson | 5/334 |
| 4,488,323 | | 12/1984 | Colburn | 5/460 |
| 4,802,250 | | 2/1989 | Farr | 5/482 |
| 4,815,156 | | 3/1989 | Williams | 5/485 |
| 4,934,939 | | 6/1990 | Bonneville | 434/247 |
| 5,018,232 | * | 5/1991 | Sachetti | 5/482 |
| 5,208,926 | | 5/1993 | Stackhouse | 5/482 |
| 5,457,830 | * | 10/1995 | Fox et al. | 5/486 |
| 5,655,236 | * | 8/1997 | Murray | 5/482 X |

* cited by examiner

*Primary Examiner*—Michael F. Trettel
(74) *Attorney, Agent, or Firm*—Richard J. Grundstrom

(57) ABSTRACT

The center indicator for bedding of this invention includes an indicator of the center line or mid-point between edges of bedding materials, or bed cloths, sheets, blankets, bed spreads, comforters, quilts, coverlets, and other bedding. The center indicator marks or makes obvious the center line of the bedding. This provides an easy method for a person to quickly and properly make a bed with equal amounts of material falling on each side of the bed. It eliminates the need to move back and forth to adjust the bedding material. Since the use of the center indicator for bedding makes it easy to position the bedding, the provisions of this invention are very helpful in teaching and helping a child or mentally impaired person to make a bed. The center indicator could be by many different methods. The center indicator could be woven into the material, stripes could be included, a different colored thread could be inserted along a center line during manufacturing or later installed, a unique pattern could mark the center, monograms or logos could be used by specific manufactures or distributors, or any other markings or indicators that specifically marks the center for use in making beds. An additional embodiment includes marking the head boards and/or footboards with a center indicator. This allows the center indicator on the bedding to be aligned with the markings on the head board and foot board. In addition a mattress on which the bed cover is to be used can also include a center indicator for aligning the center indicator on the bedding.

16 Claims, 4 Drawing Sheets

CENTER INDICATOR FOR BEDDING

BACKGROUND OF THE INVENTION

The present invention relates to a center indicator for bedding and more particularly to provisions for centering bedding when making a bed.

Institutions that have a large number of beds, such as hospitals, hotels, motels, nursing homes and others, have housekeepers that spend considerable amount of time making beds. One of the time consuming tasks is centering sheets, blankets, and comforters, coverlets and bed spreads. If not centered one side will hang down to far and the other side will be too short. When making the bed, the person often walks back and forth between sides adjusting the bedding a couple times to ensure the bedding is centered. This takes time and when there is a large number of beds to be made, the time adds up to be a considerable amount of time. This invention addresses this problem. It provides a way to quickly and accurately center bedding to quickly make a bed and save a considerable amount of time. This invention allows centering of bedding so equal amounts of material would fall on both sides of the bed with the first placing.

With this invention, the bed making process is much faster, easier and results in neater looking made beds. It is a time saver for the housekeepers and as a result will decrease costs associated with house keeping, especially in large institutions.

Accordingly, it is an object of the present invention to provide a center indicator for bedding adapted for use with sheets, blankets, bed spreads, quilts, coverlets, comforters, and/or any other bed covering or linin.

Another object of the present invention is to provide a center indicator for bedding to provide a means of rapidly making a bed. When many beds are to be made the time saving is considerable and can result in much lower costs for house keeping. However, this invention can be used by individuals as well as institutions.

A further object of the present invention is to provide a center indicator for bedding that is adapted for use on newly manufactured bedding as well as for use on existing bedding.

Another object of the present invention is to provide a center indicator for bedding that can be used to help teach a child or mentally impaired person to make a bed. This invention helps a child or mentally impaired person properly position bedding when making a bed.

To accomplish the foregoing and other objects of this invention there is provided a center indicator for bedding and more particularly to an indicator on bedding to mark the center of the bedding for aligning the bedding material on the first placement.

SUMMARY OF THE INVENTION

The center indicator for bedding of this invention includes an indicator of the center line or mid-point between edges of bedding materials, or bed cloths, sheets, blankets, bed spreads, comforters, quilts, coverlets, and other bedding. The center indicator marks or makes obvious the center line of the bedding. This provides an easy method for a person to quickly and properly make a bed with equal amounts of material falling on each side of the bed. It eliminates the need to move back and forth to adjust the bedding material. This provides a time saver for housekeepers of motels, hotels, hospitals, nursing homes, and other types of institutions having numerous bed to be made.

Since the use of the center indicator for bedding makes it easy to position the bedding, the provisions of this invention are very helpful in helping a child or mentally impaired person to make a bed. The center indicator is used to help teach how to center a sheet, blanket, bed spread or other bedding.

In accordance with the scope and limitations of this invention, the center indicator could be by many different methods. It could be woven into the material, stripes could be included, a different colored thread could be inserted along a center line during manufacturing or later installed, a unique pattern could mark the center, monograms or logos could be used by specific manufactures or distributors, or any other markings or indicators that specifically marks the center for use in making beds.

An additional embodiment includes the use of a centering design incorporated on head and foot boards or by marking the head boards and/or footboards with a center indicator. This allows the indicator on the bedding to be aligned with the markings on the head board and foot board. This feature decreases the amount of time expended in making a bed. This feature also makes it easy for a child or mentally impaired person to make a bed by aligning the center indicator on the bedding with the center marks or design on the head board and foot board.

The above mentioned and other objects, and features of the present invention will be better understood and appreciated from the following detailed description of the main embodiment thereof, selected for purposes of illustration and shown in the accompanying drawings.

DETAILED DESCRIPTION

Figure 3:
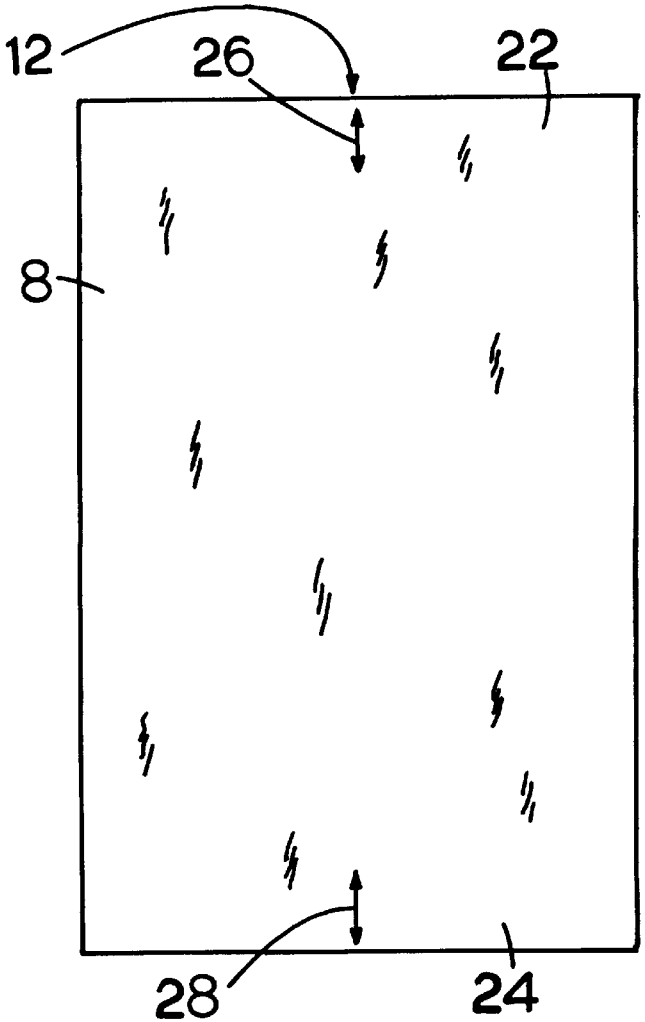
FIG. 3 illustrates another embodiment of the center indicator for bedding.

Referring now to the drawings in general there is shown various embodiments for the center indicator for bedding 10 of this invention.

The invention consists of any indicator 12 of the center line or mid-point between edges of the bedding material 8. This can include a center indicator 12 on any bed cloths, such as sheets, blankets, bed spreads, quilts, comforters, coverlets, mattress covers, and any other type of bed covering. The center indicator 12 marks or makes obvious the center of the bedding. This provides an easy method for a person to quickly and properly make a bed with equal amounts of material hanging over on each side of the bed. It eliminates the need to move back and forth or from side to side to adjust the bedding material. This provides a time saver for housekeepers of motels, hotels, hospitals, nursing homes, and other types of institutions having numerous beds to be made. It also provides a way to teach a child or mentally impaired person to properly position bedding when making a bed.

In accordance with this invention, the center indicator 12 could be included on bedding 8 by many different methods. It could be woven into the material, sewn into the bedding, stripes could be included, a different colored thread could be inserted along a center line during manufacturing or later installed, a unique pattern could mark the center, monograms or logos could be used by specific manufactures or distributors, or any other markings or indicators that specifically mark the center of the bedding for use in making beds is considered within the scope of this invention. This invention is not limited by the specific descriptions herein described.

Many bed have designs or patterns in the foot boards and head boards. These designs often have a natural occuring centering mark or design in the head and foot boards. Another embodiment of this invention includes incorporating center marks 16 and 20 on head board 14 and/or foot board 18 on bed 8 or use the existing design. The mark 16 and 20 can be on one or the other or both. This provides an easy means of alignment and centering of the bedding 8. The center indicator 12 on the bedding is simply aligned with the design or center marks 16 and 20 on the head board 14 and foot board 18. These provisions also helps a child or mentally impaired person to make and learn to make a bed.

Various embodiments and the best mode contemplated of the center indicator for bedding of the present invention are herein described. However, it should be understood that the various embodiments and best mode for carrying out the invention hereinafter described is offered by way of illustration and not by the way of limitation. It is intended that the scope of the invention include all modifications which incorporate its principal design features.

Figure 1:
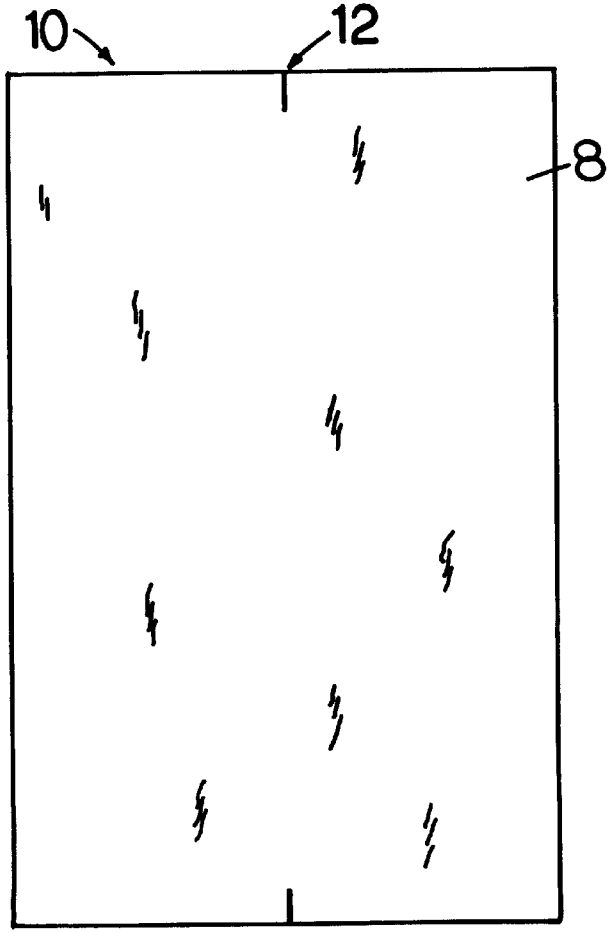
FIG. 1 illustrates one embodiment of the center indicator for bedding on a flat sheet, a blanket or other single covering.
Figure 2:
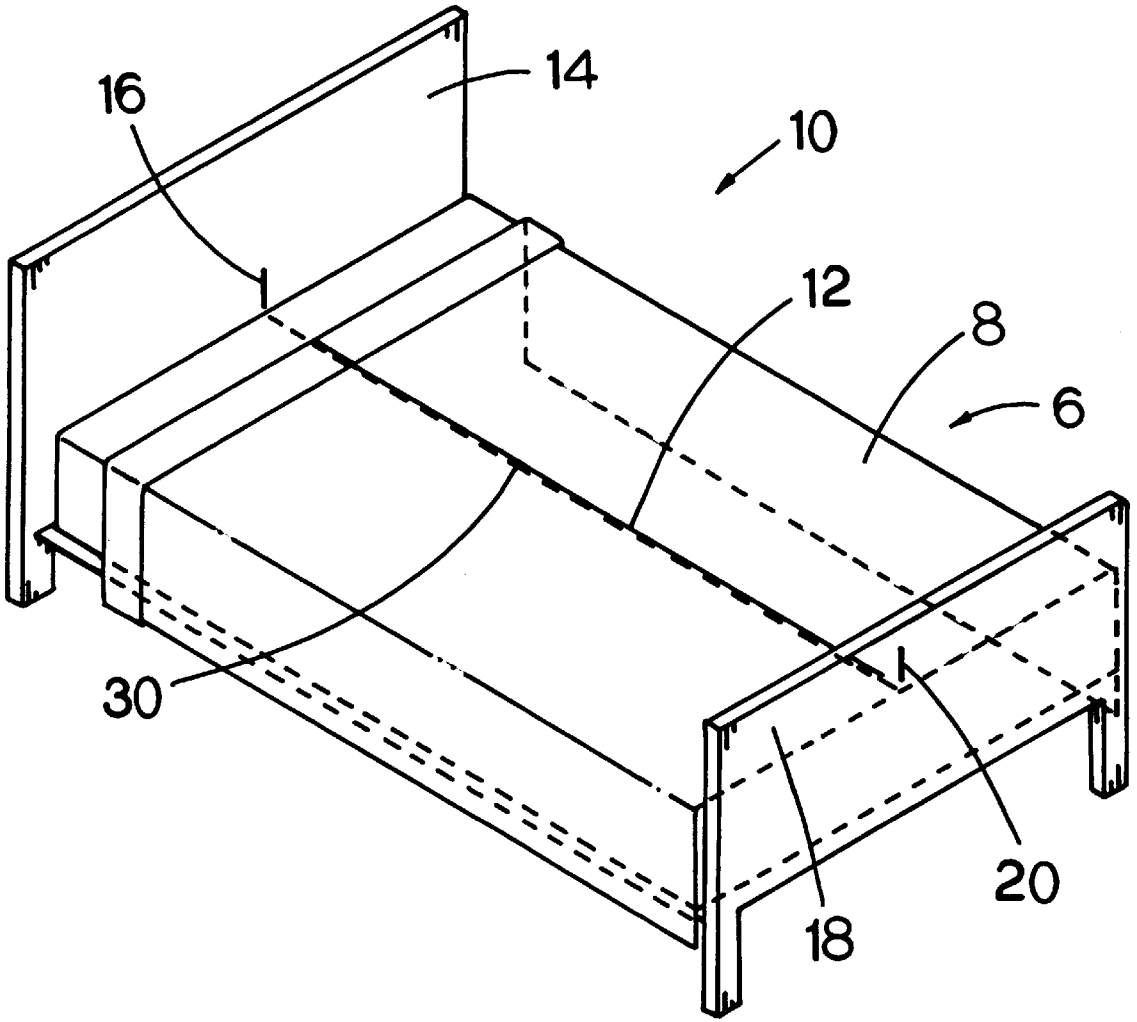
FIG. 2 illustrates a bed with center marks on the foot board, center marks on a head board and a single covering of the bed with the center indicator for bedding aligned with the center marks on the head board and foot board.

FIG. 1 shows a flat sheet or bed covering, or bedding 8 of any kind, having a center indicator 12 along a centerline along the length of the sheet 8. FIG. 2 shows the bedding 8 on a bed 6, as one embodiment. In another embodiment of the invention, the head board 14 also has a center marking 16 to mark the center of the head board and the foot board 18 has a center mark 20 to mark the center location of the foot board. In a first embodiment, the center indicator 12 on bedding 8, such as a sheet, is simply aligned along a center line of the mattress on the bed 8 and the bedding is centered. In a second embodiment of the invention, the center marks 16 and/or 20 are included on the head board 14 and/or foot board 18 to make alignment even more simple. In this second embodiment, the center indicator 12 on bedding 8 is simply aligned with the center mark or marks provided on the head board and/or the foot board, or aligned with the pattern or design of the inscorpororated within the head board and foot board. The pattern or design could also be marked with centering marks 16 and 20 so that the center is easily identifed, especially by the child or mentally impaired.

In the preferred embodiment, the sheet or bed cover or bedding is made as any other type of sheet, quilt, blanket, comforter, coverlet, mattress cover, mattress pad, or any other type of bed cover. In this embodiment, the center indicator 12 is simply a thread or multiple threads of a different color, or of a different weight, used along the center. The thread can be included in the manufacturing process and woven right into the material as it is made, or it can be later sewn into the material. The center indicator 12 can be a single thread or, if multiple threads are used, could also be in the form of a stripe.

Another method, would be to just mark the center line of the sheet 8 at the top end 22 and bottom end 24 of the bed cover 8 as illustrated in FIG. 3. The center indicator 12 could be just a short marking 26 along the top end 22, and/or a short mark 28 along the bottom end 24. The ends markings 26 and 28 would simply be used to center the bedding 8 as the bed is made.

Figure 4:
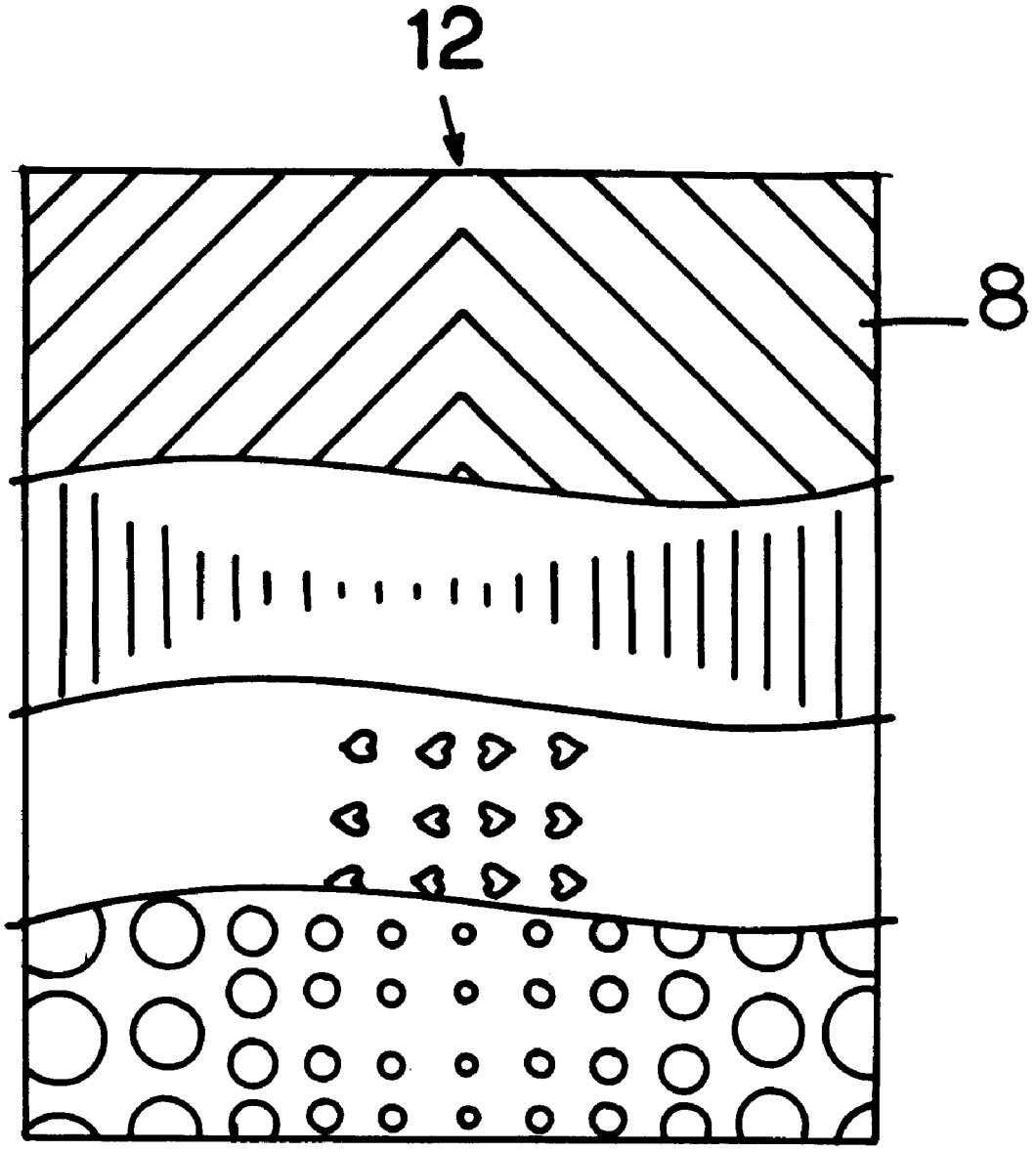
FIG. 4 illustrates how various patterns can incorporate the center indicator for bedding.

Several different embodiments are shown and are herein described. All center indicators 12 mark the center location or centerline of the length of the bed covering or bedding 8. FIG. 4 shows various types of patterns 28 with the pattern marking the the center line and the center indicator 12. The patterns can be of any pattern as desired as long as the pattern has a specific means of identifying the center line.

Figure 5:
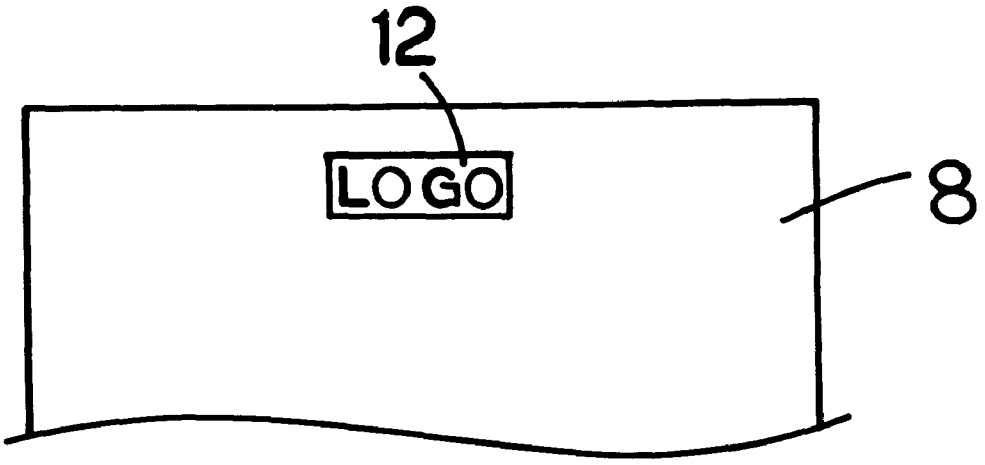
FIG. 5 illustrates the incorporation of a logo for use as a center indicator.
Figure 6:
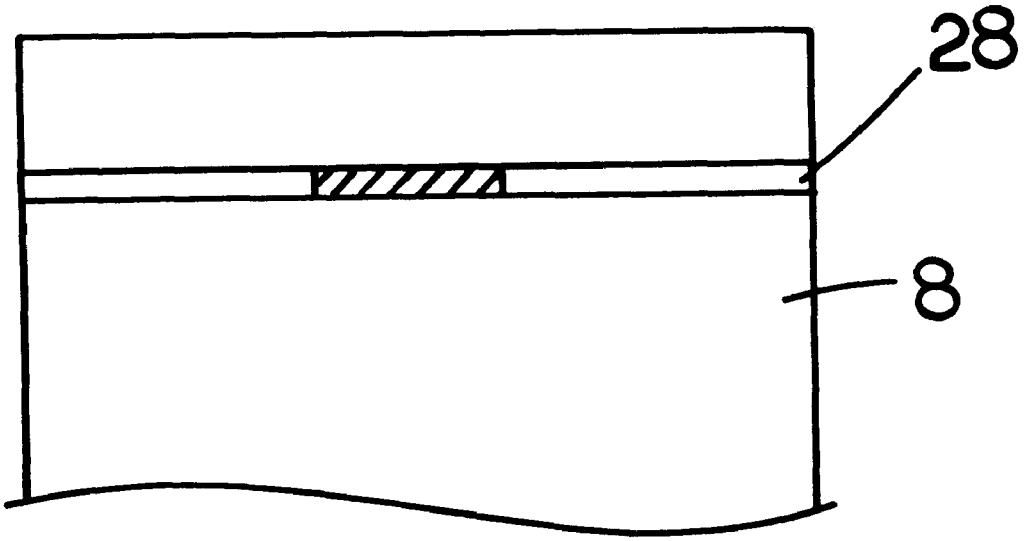
FIG. 6 illustrates the incorporation of a center indicator in the hem of a sheet.

FIG. 5 shows a center indicator 12 being a logo. Specific manufactures could include their logo at a center location at a short distance from the edge of the bedding 8. The logo then becomes the center indicator 12. FIG. 6 shows a bedding 8 with hem 26. In the center of the hem 26 there is a different color included or a design or pattern added. The different color, pattern or design is the center indicator 12 for use in centering the bedding 8 when making beds. The design, pattern or color can be within the hem, on the bedding a short distance from the edge or it can be included along the entire length.

The second embodiment of this invention, as indicated above includes a center mark 16 and 20 on either the head board 14, or foot board 18 or included on both. These marks can be included during manufacture, typically within a design or pattern, or the marks can be later added. Additionally, to make it easier for the child or mentally impaired to locate the center, the pattern or design could be marked to make it an obvious centering mark 16 and 20.

When making a bed 6, the bedding 8 is simply placed on the bed 6 with the center indicator 12 along the bed's centerline. The mattress can also be marked with a center line 30 or center indicator 12. This provides an easy and quick method of centering the bedding with equal lengths hanging down on each side.

In the second embodiment of the invention, the center indicator 12 is simply aligned with the center mark 16 on head board 14 and/or with the center mark 18 on foot board 18. This second embodiment, makes it possible to make a bed very fast and with equal amounts of the bedding 8 hanging over each side of the bed.

Another advantage of this invention is that as the bed is made, the center indicator 12 on the bottom sheet is used as a guide to align the center indicator 12 on the top sheet. The center indicator 12 on the top sheet is then used to align the center indicator 12 on a blanket. The center indicator 12 of the blanket is then used to align with the center indicator 12 on a bed spread, quilt or comforter. This alignment process allows a bed to be made very quickly, and very neatly. A considerable amount of time is thus saved.

Once the first bed cover 8 is placed, all center indicators of the bed coverings 8 above the sheet are simply aligned with the lower center indicator 12.

These provision and method makes it easy for a child or a mentally impaired person to make and learn to make a bed.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A center indicator for bedding comprising:

a bed covering comprising a top sheet and subsequent bed coverings each having a length and a width, and a center indicator to mark a half of said width of said bed covering extending along and defining a centerline for the length of each of said bed covering, said center indicator used to center said bed covering on a bed when said bed is being made by aligning said center indicators with centering marks on a mattress, footboard, headboard, or both the head board and foot board, and by aligning said center indicator with said center indicator of an underlaying bed covering such that equal amounts of said bed covering hangs down opposite sides of said bed; and a center indicator comprising a logo of a manufacture, or distributor of said bedding, said logo being incorporated with said center indicator and positioned a short distance from one end or both ends of said bedding.

2. The center indicator for bedding as set forth in claim 1 in which said bed cover is selected from the group comprising bed linen, top sheet, blanket, quilt, bed spread, comforter, coverlet, mattress cover, mattress pad, article of bedding, and a cloth covering for a bed.

3. The center indicator for bedding as set forth in claim 1 in which said bed indicator comprises a single thread incorporated within the bed cover material during manufacture or later sewn into said bed cover.

4. The Center indicator for bedding as set forth in claim 1 in which said bed indicator only marks a centerline of said bed cover at a top end, or bottom end, or both top and bottom ends of said bed cover, said center indicator extending from said end or ends and inward toward a center of said bedding.

5. The center indicator for bedding as set forth in claim 1 in which center indicator is a pattern with a specific means within said pattern to indicate the centerline of said bed cover.

6. The center indicator for bedding as set forth in claim 1 in which said center indicator is incorporated with a hem of said bed cover.

7. A center indicator for bedding comprising:

a bed cover having a length and a width;

a center indicator to mark a half of said width of said bed cover and to define a centerline for the length of said bed cover, said center indicator used to center said bed cover on a bed when said bed is being made; and a center mark on a head board, or foot board, or a center mark on both head board and foot board of a bed on which said bedding with center indicator is to be used, said center mark or marks for alignment of said center indicator on said bedding.

8. A center indicator for bedding comprising:

a bed cover having a length and a width;

a center indicator to mark a half of said width of said bed cover and to define a centerline for the length of said bed cover, said center indicator used to center said bed cover on a bed when said bed is being made; and a center indicator along a centerline of a mattress, said center indicator on said mattress used to position bedding by alignment of said center indicator on said bedding with said center indicator on said mattress.

9. A center indicator for bedding comprising:

a bed cover, such as a sheet, bed linen, blanket, quilt, bed spread, comforter, coverlet, mattress cover, mattress pad, article of bedding, or a cloth covering for a bed, said bed cover having a length and a width:

a center indicator to mark a half of said width of said bed cover extending along its length and defining a centerline for the length of said bed cover, said center indicator being incorporated into said bed cover during manufacture or added afterwards, said center indicator used to center said bed cover on a bed when said bed is being made;

said center indicator being aligned with a centering mark on a mattress, a mark on a foot board, head board or both said foot board and head board, and aligned with centering marks on an underlaying bed cover, such that said bed cover can be properly positioned and aligned on a bed with equal amounts of said bed cover overhanging opposite sides of said bed; and said center indicator comprising a logo of a manufacture, or distributor of said bedding, said logo positioned within said center indicator a short distance from one end or both ends of said bedding.

10. The center indicator for bedding as set forth in claim 9 in which said bed indicator comprises a single thread incorporated within the bed cover material during manufacture or later sewn into said bed cover.

11. The center Indicator for bedding as set forth in claim 9 in which center indicator is a pattern with a specific means within said pattern to indicate the centerline of said bed cover.

12. A center indicator for bedding comprising:

a bed cover, such as a sheet, bed linen, blanket, guilt, bed spread, comforter, coverlet, mattress cover, mattress pad, article of bedding, or a cloth covering for a bed, said bed cover having a length and a width: and a center indicator to mark a half of said width of said bed cover and to define a centerline for the length of said bed cover, said center indicator being incorporated into said bed cover during manufacture or added afterwards, said center indicator used to center said bed cover on a bed when said bed is being made; and a center mark on a head board, or foot board, or a center mark on both head board and foot board of a bed on which said bedding with center indicator is to be used, said center mark or marks for alignment of said center indicator on said bedding.

13. A center indicator for bedding comprising:

a bed cover, such as a sheet, bed linen, blanket, guilt, bed spread, comforter, coverlet, mattress cover, mattress pad, article of bedding, or a cloth covering for a bed, said bed cover having a length and a width: and a center indicator to mark a half of said width of said bed cover and to define a centerline for the length of said bed cover, said center indicator being incorporated into said bed cover during manufacture or added afterwards, said center indicator used to center said bed cover on a bed when said bed is being made; and a center indicator along a centerline of a mattress, said center indicator on said mattress used to position bedding by alignment of said center indicator on said bedding with said center indicator on said mattress.

14. A method of making a bed using a center indicator for bedding in which the steps comprising:

incorporating a center indicator on a bed cover to mark or make obvious a center line of said bed cover;

incorporating a center indicator along a length of a mattress to mark a center line on said mattress;

placing said bed cover on a bed; and aligning said center indicator on said mattress with said center indicator on said bed cover, such that equal amounts of said bed cover falls on each side of said bed.

15. A method of making a bed using a center indicator for bedding in which the steps comprising:

incorporating a center indicator on a bed cover to mark or make obvious a center line of said bed cover;

marking a center location of a foot board, or a head board, or both the head board and foot board;

placing said bed cover on a bed; and using said mark or marks for positioning said bed cover by aligning said center indicator on said bed cover with said mark or marks, such that equal amounts of said bed cover falls on each side of said bed.

16. A method of making a bed with center indicator for bedding the steps comprising:

incorporating a center indicator on one or more bed covers, such as a top sheet, bed linen, blanket, quilt, bed spread, comforter, coverlet, mattress cover, mattress pad, article of bedding, or a cloth covering for a bed to mark or make obvious a center line of said bed cover;

placing a first bed cover on a bed;

aligning said center indicator on said first bed cover with a centerline of said bed by aligning said center indicator with center marks on a head board, a foot board, or both said foot board and head board, such that equal amounts of said bed cover falls on each side of said bed: and placing a second bed cover, and subsequent bed covers thereafter, over said first bed cover and subsequent bed covers;

using said center indicator on an underlaying bed cover as a center line to align a center indicator on said second bed cover or subsequent bed covers.

* * * * *